US007270070B1

(12) United States Patent
Kuhlman

(10) Patent No.: US 7,270,070 B1
(45) Date of Patent: Sep. 18, 2007

(54) TOOTH AND FRICTION LIGHTERING ARRANGEMENT

(75) Inventor: Clare J. Kuhlman, Platte Woods, MO (US)

(73) Assignee: Intercontinental Engineering Manufacturing Corporation, Riverside, MO (US)

( * ) Notice: Subject to any disclaimer, the term of this patent is extended or adjusted under 35 U.S.C. 154(b) by 0 days.

(21) Appl. No.: 11/552,305

(22) Filed: Oct. 24, 2006

Related U.S. Application Data

(60) Provisional application No. 60/762,408, filed on Jan. 26, 2006.

(51) Int. Cl.
*B63B 21/56* (2006.01)

(52) U.S. Cl. ..... 114/248; 114/249

(58) Field of Classification Search ..... 114/248, 114/249, 250
See application file for complete search history.

(56) References Cited

U.S. PATENT DOCUMENTS 4,688,507 A * 8/1987 Kuhlman et al. ..... 114/249
6,199,501 B1 * 3/2001 Kuhlman ..... 114/248
6,487,985 B1 * 12/2002 Kuhlman ..... 144/248

* cited by examiner

*Primary Examiner*—Stephen Avila
(74) *Attorney, Agent, or Firm*—Spencer Fane Britt & Browne LLP

(57) ABSTRACT

A system (10) for coupling first and second vessels (12,14) to minimize movement therebetween while allowing for lightering. The system (10) comprises rams (20,22) and coupling heads (36,38) associated with the first vessel (12), and receivers (24,26) associated with the second vessel (14) for receiving the coupling heads (36,38). The system (1) allows for at least three configurations: a first configuration in which the rams (20,22) are extended and the coupling heads (36,38) are rotated such that first faces (42) interlock with the receivers (24,26); a second configuration in which the rams (20,22) are extended and the coupling heads (36,38) are rotated such that second faces (44) abut the receivers (24,26); and a third configuration in which the rams (20,22) are retracted such that the coupling heads (36,38) do not interact with the receivers (24,26). Lightering is accomplished by a series of short-duration switches between the second and third configurations.

20 Claims, 4 Drawing Sheets

EXISTING HEAVY SEA CONNECTION
TOOTHED INTERFACE
TO FIX
VERTICAL POSISTION

LIGHTERING CONNECTION
FLAT INTERFACE TO ALLOW VERTICAL MOTION

SHORT DURATION RELEASE OF VERTICAL MOTION CONTROL TO ELIMINATE TUG TO BARGE DRAFT DIFFERENTIAL

LONGITUDINAL CONTROL MAINTAINED

TUG ROLL CONTROLLED BY FENDERS AND CLEARANCE TO BARGE NOTCH

TOOTH AND FRICTION LIGHTERING ARRANGEMENT

CROSS REFERENCE TO RELATED APPLICATIONS

The present non-provisional patent application claims priority benefit of an earlier-filed provisional patent application of the same title, Ser. No. 60/762,408, filed Jan. 26, 2006. The identified earlier-filed application is hereby incorporated by reference into the present application.

BACKGROUND OF THE INVENTION

1. Field of the Invention

The present invention relates to system and methods for coupling powered pusher vessels to unpowered vessels. More specifically, the present invention concerns a system for coupling a first vessel, such as a tugboat or other pusher vessel, with a second vessel, such as an unpowered barge, to minimize undesirable movement therebetween while allowing for lightering, i.e., compensating for changes in the relative vertical positions, or draft differential, of the vessels as weight is added or removed from one or both of the vessels.

2. Background of the Invention

Barges are used to transport cargo on water but have no self-propelling mechanisms and therefore rely primarily on tugboats or other pusher vessels for movement from one location to another. There exist many types of connections for coupling tugboats to barges, and the particular form of connection used depends on the marine environment in which the transportation takes place. A more secure coupling arrangement is required to maintain the connection of the tugboats to the barges in rough waters. For example, when a barge is used to transport oil, the coupling of the tugboat to the barge, the loading of the barge, and the actual pushing of the loaded barge take place on open sea and are subject to substantial waves. The tugboats must be securely connected to the barges to prevent the tugboats from being tossed against the barges, otherwise substantial damage and injury can occur.

One type of connection involves extendable ram devices on the tugboats which interconnect with receivers on the barges. This connection is achieved by the bow of the tugboat entering a generally U-shaped or V-shaped notch in the barge. Once the tugboat is within the notch, the port and starboard rams are extended from the tugboat into the corresponding receivers on the barge using a drive mechanism that generates sufficient force to securely hold the tug within the notch in the barge. This type of connection is suitable when the barge maintains a fixed load and the tugboat merely transports the barge. However, a tugboat must frequently transport a barge to a first destination where the barge receives a load, and then transport the barge to a second destination where the barge is unloaded. During the loading and unloading operations, the respective drafts of the tugboat and the barge will change relative to each other as a function of the changing load weight. For example, when the barge is empty, it will sit relatively high in the water. As the barge is loaded, the weight of the load will cause the barge to sit lower in the water. Because the weight of the tugboat does not change, its draft remains constant. If the tugboat were to remain fixedly connected to the barge during the loading operation, the weight of the load would push the tugboat down into the water, with possibly disastrous consequences. The tugboat must, however, maintain some degree of connection with the barge during loading or else wave or wind action may prevent subsequent realignment and reconnection. Therefore, the connection must permit the relative heights above the water of the tugboat and the barge to change as the weight of the load changes. The process by which the tugboat adjusts its position relative to the connected barge as the weight of the load is changed is called "lightering."

Another type of connection provides receivers in the form of vertical channels on the port and starboard sides of the notch in the barge for receiving the rams. The vertical channels extend from the top to the bottom height of the barge and have a wedge-shaped configuration which opens into the notch (inboard). The rams are provided with coupler heads having a similar wedge-shaped configuration, and which are oriented on the rams to mate with the vertical channels. A series of teeth are arranged along the sidewalls of the vertical channels. Similarly, a series of teeth are arranged along the lateral sides of the coupler heads. As the rams are extended and brought into engagement with the vertical channels, their respective teeth interlock. The depth of the teeth permits sufficient engagement to substantially prevent relative vertical movement of the tugboat with respect to the barge.

To permit relative vertical movement of the barge with respect to the tugboat, the rams are retracted a sufficient distance so that the teeth of the coupler heads completely disengage from the teeth of vertical channels. With this type of connection, any contact between the coupler heads and the barge when disengaged can causes the rams to rotate, thereby misaligning the respective teeth and making reengagement difficult. Furthermore, complete disengagement results in a loss of longitudinal and tugboat roll control. Any time that the rams disengage from the receivers, there is a potential for mishap, especially in rough wave or wind action. More specifically, whenever the tugboat and barge are disconnected in this manner, the tugboat is allowed to roll in the notch.

SUMMARY OF THE INVENTION

The present invention provides a system that allows for coupling a first vessel, such as a tugboat or other pusher vessel, with a second vessel, such as an unpowered barge, to minimize undesirable movement therebetween while allowing for lightering, i.e., compensating for changes in the relative vertical positions, or draft differential, of the vessels as weight is added to or removed from one or both of the vessels. More specifically, the system minimizes the amount of time required to reengage the vessels during lightering, and thereby minimizes the potential for a loss of longitudinal control and for the first vessel to roll in the notch.

In one embodiment, the system broadly comprises a ram associated with the first vessel, with the ram being selectively extendable and retractable, and a coupling head associated with an end of the ram. The coupling head includes a pair of first faces located on opposite sides of the coupling head, with each first face including one or more first engagement structures, and a pair of second faces located on opposite sides of the coupling head, with each second face including a substantially flat surface. The coupling head is selectively rotatable so as to position either the pair of first faces or the pair of second faces for physical interaction with the second vessel. There are at least two such rams and coupling heads, including a first ram and a first coupling head associated with a port side of the first vessel and a second ram and a second coupling head associated with a starboard side of the first vessel. The second vessel presents a receiver including an elongated vertical channel having sidewalls, and wherein the sidewalls include one or more second engagement structures adapted to interlock with the one or more first engagement structures. The one or more first engagement structures and the one or more second engagement structures are interlocking teeth. The substantially flat surface of each second face is a friction surface. Each first face is ninety degrees removed from each second face about the coupling head.

The system further includes a control system for selectively extending and retracting the ram and for selectively rotating the coupling head so as to allow for affecting at least three configurations. In a first configuration, the ram is extended and the coupling head is rotated such that the pair of first faces are oriented vertically to interact with a receiver on the second vessel. In a second configuration, the ram is extended and the coupling head is rotated such that the pair of second faces are oriented vertically to interact with the receiver on the second vessel. In a third configuration, the ram is retracted and the coupling head does not interact with the receiver of the second vessel.

These and other features of the present invention are described in more detail in the section titled DETAILED DESCRIPTION OF THE INVENTION, below.

BRIEF DESCRIPTION OF THE DRAWING FIGURES

A preferred embodiment of the present invention is described in detail below with reference to the attached drawing figures, wherein.

DETAILED DESCRIPTION OF THE INVENTION

Figure 1:
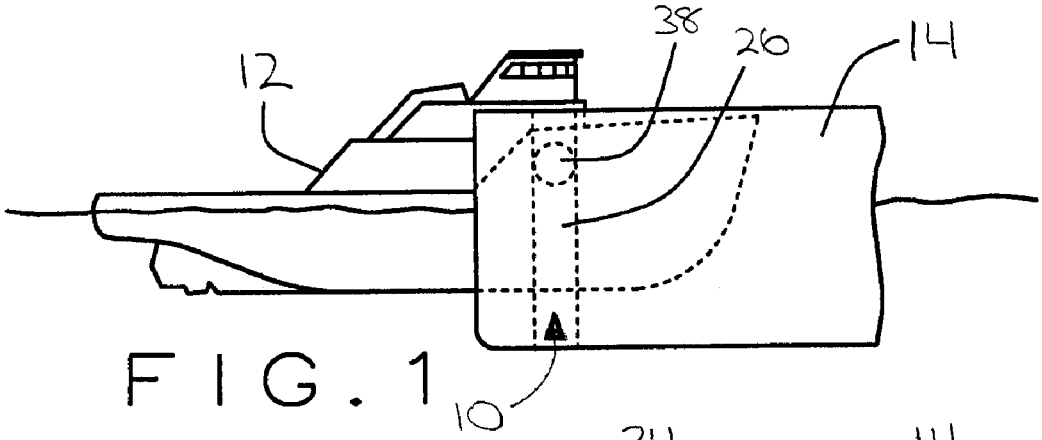
FIG. 1 is an elevation view of a first vessel received within a notch of a second vessel.
Figure 2:
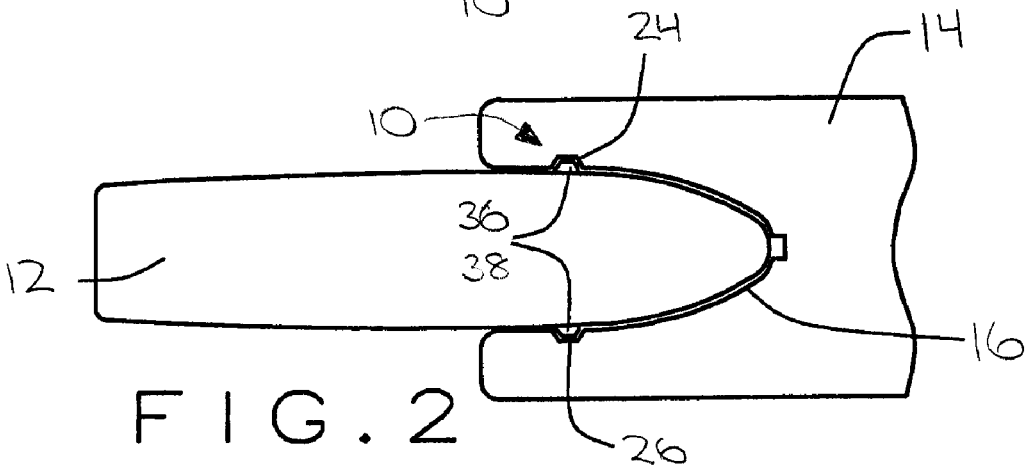
FIG. 2 is a plan view of the first vessel received within the notch of the second vessel.
Figure 3:
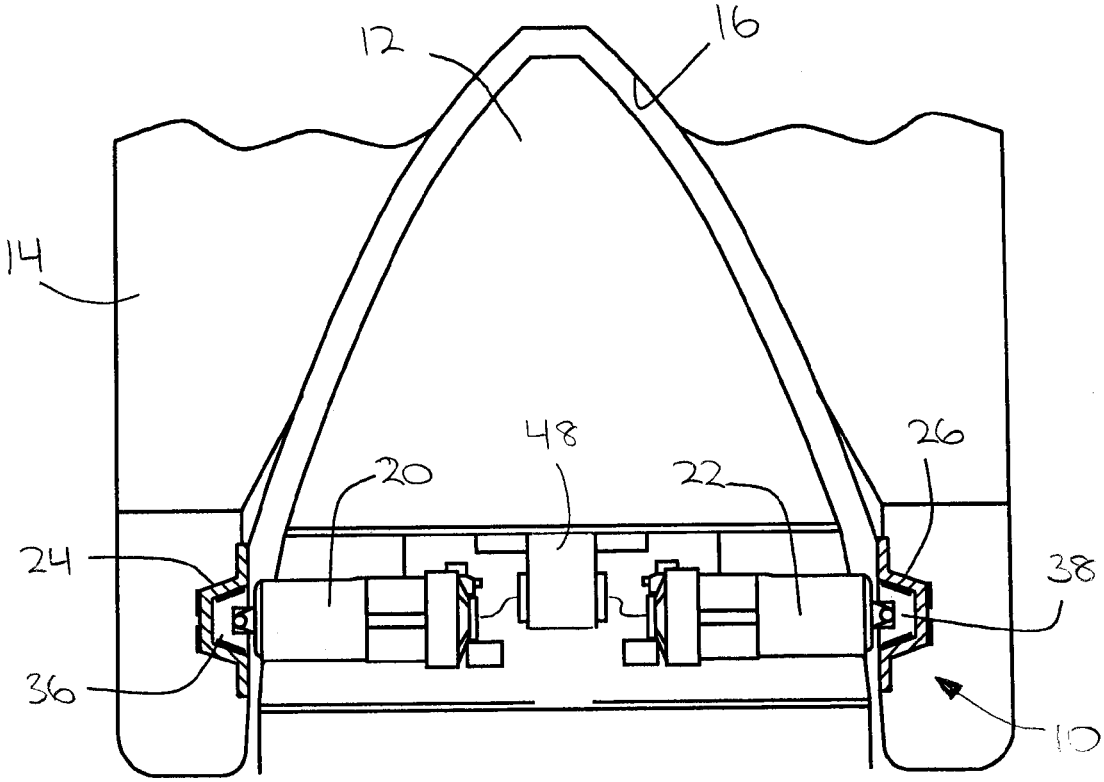
FIG. 3 is a fragmentary sectional plan view of an embodiment of the vessel coupling system of the present invention.

With reference to the drawings figures, a vessel coupling system 10 is herein described, shown, and otherwise disclosed in accordance with a preferred embodiment of the present invention. Broadly, the system 10 allows for coupling a first vessel 12, such as a tugboat or other pusher vessel, with a second vessel 14, such as an unpowered barge, to minimize undesirable movement therebetween while allowing for lightering, i.e., compensating for changes in the relative vertical positions, or draft differential, of the vessels 12,14 as weight is added to or removed from one or both of the vessels 12,14. More specifically, the system 10 minimizes the amount of time required to reengage the vessels 12,14 during lightering, and thereby minimizes the potential for a loss of longitudinal control and for the first vessel 12 to roll in the notch 16.

Figure 4:
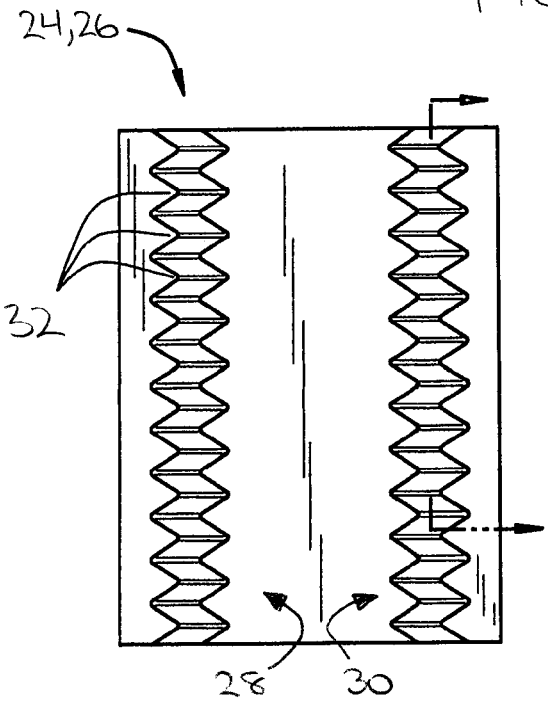
FIG. 4 is a fragmentary elevation view of a receiver portion of the vessel coupling system.
Figure 5:
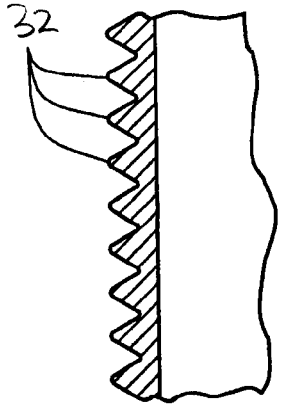
FIG. 5 is a fragmentary sectional view of the receiver portion of FIG. 4.

Referring to FIGS. 1-5, the bow of the first vessel 12 is shown positioned within the generally U-shaped or V-shaped notch 16 in the second vessel 14. The first vessel 12 is equipped with at least two selectively extendable and retractable rams, with a first ram 20 being associated with a port side of the first vessel 12 and a second ram 22 being associated with a starboard side of the first vessel 12. The second vessel 14 is equipped with at least two receivers, with a first receiver 24 being associated with a port side of the notch 16 in the second vessel 14 and a second receiver 26 being associated with a starboard side of the notch 16 in the second vessel 14. Referring particularly to FIGS. 4 and 5, each receiver 24,26 includes a pair of sidewalls 28,30, and each sidewall 28,30 presents a plurality of engagement structures 32. The engagement structures 32 may take any suitable shape. In one embodiment, for example, the engagement structures 32 are wedge-shaped teeth. Each receiver 24,26 has a wedge, or tapered, shape, with the widest portion of the wedge opening into the notch 16.

Figure 6:
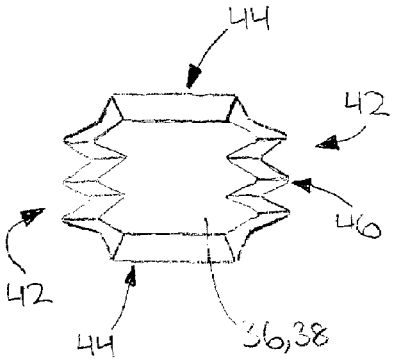
FIG. 6 is an elevational view of a coupling head portion of the vessel coupling system.
Figure 8:
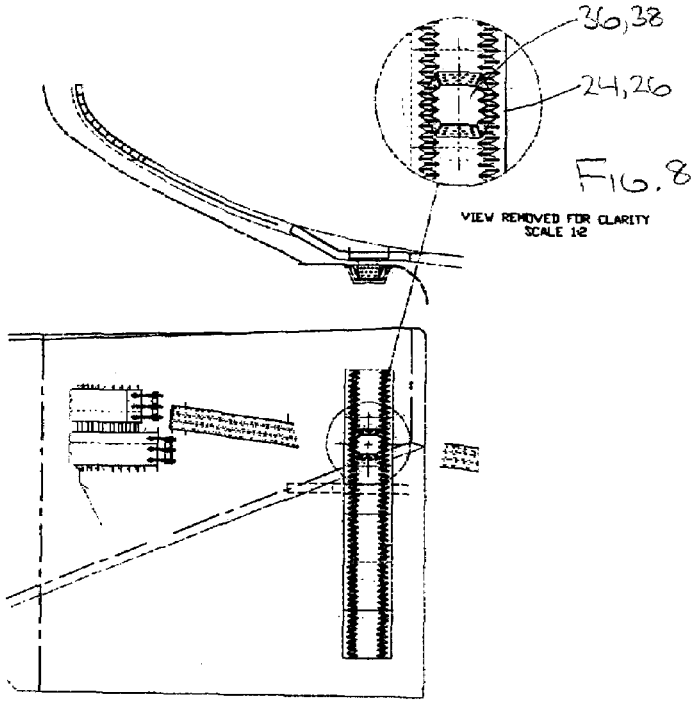
FIG. 8 is a fragmentary section elevation view of the receiver and coupling head in the first configuration.
Figure 7:
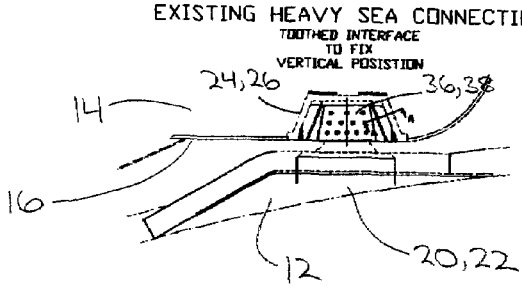
FIG. 7 is a fragmentary sectional plan view of the receiver and coupling head in a first configuration.
Figure 9:
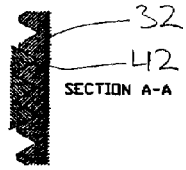
FIG. 9 is a fragmentary section elevation view of a first face portion of the coupling head interlocking with the receiver in the first configuration.
Figure 11:
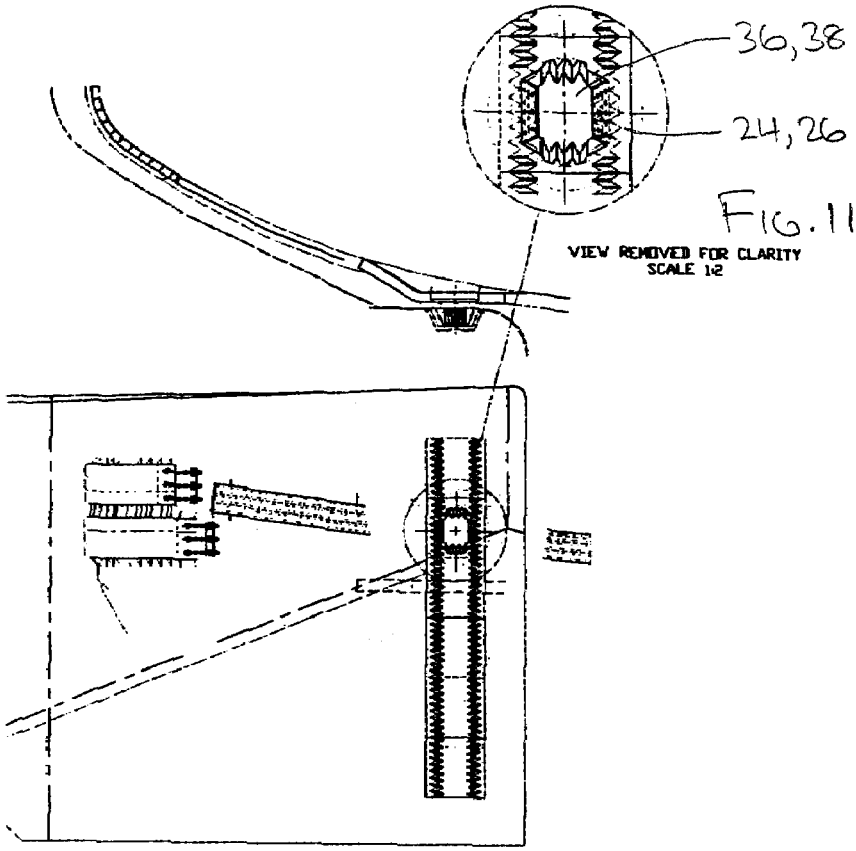
FIG. 11 is a fragmentary section elevation view of the receiver and coupling head in the second configuration.
Figure 10:
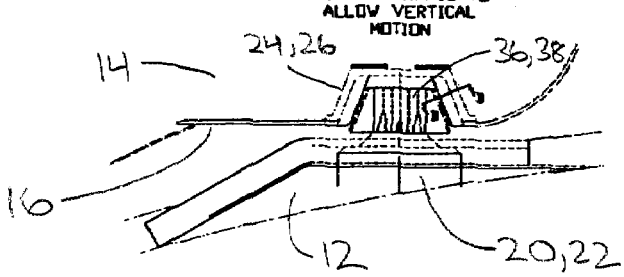
FIG. 10 is a fragmentary sectional plan view of the receiver and coupling head in a second configuration.
Figure 12:
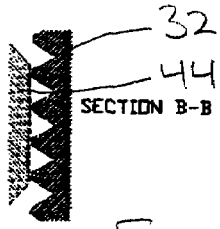
FIG. 12 is a fragmentary section elevation view of a first face portion of the coupling head abutting the receiver in the second configuration.

Referring also to FIGS. 6-12, the system 10 further comprises at least two selectively rotatable coupling heads, with a first coupling head 36 being associated with an outboard end of the first ram 20 and a second coupling head 38 being associated with an outboard end of the second ram 22. Referring particular to FIG. 6, each coupling head 36,38 includes a pair of first faces 42 and a pair of second faces 44.

Each first face 42 presents at least one engagement structure 46. When the respective ram 20,22 is extended and the respective coupling head 36,38 is rotated, the first face 42 closely interlocks with the engagement structures 32 of the respective receiver 24,26. The shape of the engagement structure 46 of the first face corresponds to the shape of the engagement structures 32 of the receiver 24,26 to allow the structures 32,46 to closely interlock.

Each second face 44 presents a substantially flat friction surface. When the respective ram 20,22 is extended and the respective coupling head 36,38 is rotated, the second face closely abuts, rather than interlocks with, the engagement structures 32 of the respective receiver 24,26. In one embodiment, the second face 44 presents minor projections or other structures to enhance friction between the second face 44 and the engagement structures 32 of the receiver 24,26. In one embodiment, the ends, or tips, of the engagement structures 32 are flattened, such as by machining, to better interact with the second face 44 while not interfering with the ability to interlock with the first face 42.

In one embodiment, each face of the pair of first faces 42 is located on an opposite side of the coupling head 36,38 as the other, and each face of the pair of second faces 44 is located on an opposite side of the coupling head 36,38 as the other, such that each face of the four faces is located ninety degrees around the coupling head 36,38 from the two faces that are adjacent to it.

The system 10 further comprises a control system 48 for selectively extending and retracting each ram 20,22 and for selectively rotating each coupling head 36,38 so as to allow for affecting at least three different configurations, which are discussed below. In one embodiment, the control system 48 includes a touchscreen for controlling the second and third configurations which is independent of the controls for the first configuration. The touchscreen presents a visual indication of ram extension and coupling head rotation angle for each of the rams 20,22, Cycle buttons for each of the rams 20,22, and load cell pressure/engagement force indicators for each of the rams 20,22.

In a first configuration, the ram 20,22 is extended and the coupling head 36,38 is rotated such that the pair of first faces 42 are oriented vertically and interlocked with the engagement structures 32 of the receiver 24,26. In this configuration, the vessels 12,14 cannot move either vertically or horizontally relative to one another to any significant degree.

In a second configuration, the ram 20,22 is extended and the coupling head 36,38 is rotated such that the pair of second faces 44 are oriented vertically and abut the engagement structures 32 of the receiver 24,26. In this configuration, relative movement of the vessels 12,14 is restricted, though not as securely as in the first configuration. More specifically, the second configuration has limited capacity for vertical loads, and its use may be limited or disallowed when wave heights exceed a pre-established minimum height. Vertical loads that exceed the holding capacity of the friction connection may cause the first vessel 12 to roll in the notch 16. Fenders may be used to limit such rolling, to avoid a total loss longitudinal control, and to prevent the first vessel 12 from exiting the notch 16 altogether.

In a third configuration, the ram 20,22 is retracted and the coupling head 36,38 is rotated such that the pair of second faces 44 are oriented vertically. Changing the draft differential requires that the force at the friction interface between the pair of second faces 44 and the receivers 24,26 must be reduced to a level at which the vertical force caused by the draft differential overcomes the friction force. One ram 20,22 is retracted an amount to reduce the friction connection force but not enough to lose longitudinal control. Because the ram 20,22 is retracted, the pair of second faces 44 do not abut the engagement structures 32 of the receiver 24,26, such that there is no direct contact between the coupling head 36,38 and the receiver 24,26. Thus, in this third configuration, the vessels 12,14 can move at least vertically relative to one another to compensate for changes in the draft differential of the vessels 12,14.

It will be appreciated that the interlocked connection of the first configuration will not allow lightering which is possible with the friction connection of the second configuration. In one embodiment, the coupling head 36,38 is completely withdrawn from the receiver 24,26, thereby allowing coupling head rotation between the first and second configurations as well as allowing the vessels 12,14 to move horizontally relative to one another. Changing between the second and third configurations allow a single vessel to perform further full sea or lightering operations, thereby making the system 10 of the present invention more versatile as well as potentially safer than the prior art.

The decision to change the draft differential by switching to the third configuration is based upon conditions. If the waves are too high or the wind is too strong, then it is advisable to wait until conditions are calmer to initiate the lightering process. Generally, compensating a larger draft differential in relatively calm conditions is preferable to compensating a smaller draft differential in rough conditions. In one embodiment, only one ram 20,22 at a time can be operated while changing between configurations such that at least one ram 20,22 is always engaged in either the first or second configuration. A headline connection may be required whenever the waves or wind tend to push the first vessel 12 out of the notch when changing between the first and second configurations.

In exemplary, but non-limiting, use and operation, the present invention may function substantially as follows when changing from the first configuration to the second configuration. In relatively calm conditions, and with the system 10 in the first configuration, an operator first secures a headline between the first and second vessels 12,14 if wave or wind action threatens to move the first vessel 12 out of the notch 16. The operator then selects the ram 20,22 having the lowest load cell pressure, and retracts the selected ram 20,22 until the coupling head 36,38 is completely disengaged from the receiver 24,26. The operator then rotates the coupling head 36,38 ninety degrees so that the pair of second faces 44 are oriented vertically. The operator then extends the ram 20,22 until the coupling head 36,38 is fully received within the receiver 24,26 and the second faces 44 abut the engagement structures 32. The operator then repeats this process with the other ram 20,22.

In exemplary, but non-limiting, use and operation, the present invention may function substantially as follows when lightering, i.e., changing between the second and third configurations, to compensate for a draft differential between the two vessels. When waves are less than eight feet high, or during a sufficient time interval between long-period waves that are less than ten feet high, and with the system 10 in the second configuration, the operator identifies the ram 20,22 having the lowest load cell pressure. The operator then actuates the control for the Cycle process for the identified ram 20,22, which engages a low speed drive clutch, starts a low speed motor, and causes the ram 20,22 to retract for a pre-established time period to decrease or eliminate the friction force between the second faces 44 and the receiver 24,26. This decrease in force allows the vessels 12,14 to move relative to one another if the vertical force caused by the draft differential overcomes the remaining friction force, if any. Once the vessels' relative movement has eliminated the draft differential, the operator releases the control for the Cycle process, which causes the motor to extend the ram 20,22 to full engagement pressure, thereby returning the system 10 to the second configuration. If the first vessel 12 re-engages with a list, or tilt, then the operator waits for the next relatively calm interval and repeats the process to allow the first vessel 12 to roll and thereby eliminate the list.

Rather than leaving the system 10 in the third configuration continuously until loading or unloading is complete, which could result in damage to the coupling heads 36,38, receivers 24,26, and other parts of the vessels 12,14, compensating for the total draft differential that arises between the initial and final loading states is accomplished by a series of releases, each being of a relatively short duration.

In exemplary, but non-limiting, use and operation, the present invention may function substantially as follows when changing from the second configuration back to the first configuration. In relatively calm conditions, and with the system 10 in the second configuration, the operator first secures a headline between the first and second vessels 12,14 if wave or wind action threatens to move the first vessel 12 out of the notch 16. The operator then identifies the ram 20,22 having the lowest load cell pressure, and retracts the identified ram 20,22 at least until the coupling head 36,38 is fully disengaged from the receiver 24,26. The operator then rotates the ram 20,22 ninety degrees so that the pair of first faces 42 are oriented vertically. The operator then extends the ram 20,22 until the coupling head 36,38 is fully received within the receiver 24,26 and the first faces 42 interlock with the engagement structures 32. The operator then repeats this process with the other ram 20,22.

From the preceding description, it will be appreciated that the system 10 of the present invention provides a number of substantial advantages over the prior art, including, for example, minimizing the amount of time required to reengage the vessels 12,14 during lightering, i.e., when changing between the second and third configurations, and thereby minimizes the potential for a loss of longitudinal control and for the first vessel 12 to roll in the notch 16. More specifically, the first configuration involves a more precise interlocking connection which can be more difficult to achieve than the less precise friction connection of the second configuration. Therefore, changing between the second and third configurations can be accomplished faster than changing between the first and third configurations, thereby making the system 10 of the present invention potentially safer than the prior art.

Although the present invention has been described with reference to the preferred embodiment illustrated in the drawings, it is noted that equivalents may be employed and substitutions made herein without departing from the scope of the invention as recited in the claims.

Having thus described the preferred embodiment of the invention, what is claimed as new and desired to be protected by Letters Patent includes the following:

1. A vessel coupling system for coupling a first vessel with a second vessel, the vessel coupling system comprising:
- a ram associated with the first vessel, with the ram being selectively extendable and retractable; and
- a coupling head associated with an end of the ram and including—
  - a pair of first faces located on opposite sides of the coupling head, with each first face including one or more first engagement structures, and
  - a pair of second faces located on opposite sides of the coupling head, with each second face including a substantially flat surface,
  - wherein the coupling head is selectively rotatable so as to position either the pair of first faces or the pair of second faces for physical interaction with the second vessel.

2. The vessel coupling system as set forth in claim 1, wherein the first vessel is powered and the second vessel is unpowered, and wherein the vessel coupling system allows for compensating for a draft differential between the first vessel and the second vessel.

3. The vessel coupling system as set forth in claim 1, wherein there are at least two rams and two coupling heads, including a first ram and a first coupling head associated with a port side of the first vessel and a second ram and a second coupling head associated with a starboard side of the first vessel.

4. The vessel coupling system as set forth in claim 1, wherein the second vessel presents a receiver including an elongated vertical channel having sidewalls, and wherein the sidewalls include one or more second engagement structures adapted to interlock with the one or more first engagement structures.

5. The vessel coupling system as set forth in claim 1, wherein the one or more first engagement structures and the one or more second engagement structures are interlocking teeth.

6. The vessel coupling system as set forth in claim 1, wherein the substantially flat surface of each second face is a friction surface.

7. The vessel coupling system as set forth in claim 1, wherein each first face is ninety degrees removed from each second face about the coupling head.

8. The vessel coupling system as set forth in claim 1, further including a control system for selectively extending and retracting the ram and for selectively rotating the coupling head so as to allow for affecting at least three configurations including—
- a first configuration in which the ram is extended and the coupling head is rotated such that the pair of first faces are oriented vertically to interact with a receiver on the second vessel;
- a second configuration in which the ram is extended and the coupling head is rotated such that the pair of second faces are oriented vertically to interact with the receiver on the second vessel; and
- a third configuration in which the ram is retracted and the coupling head does not interact with the receiver of the second vessel.

9. A vessel coupling system for coupling a first vessel with a second vessel, the vessel coupling system comprising:
- a ram associated with the first vessel, with the ram being selectively extendable and retractable;
- a coupling head associated with an end of the ram and including—
  - a pair of first faces located on opposite sides of the coupling head, with each first face including one or more first engagement structures, and
  - a pair of second faces located on opposite sides of the coupling head, with each second face including a substantially flat surface,
  - wherein the coupling head is selectively rotatable so as to orient either the first pair of faces or the second pair of faces vertically for interaction with a receiver on the second vessel; and
- a control system for selectively extending and retracting the ram and for selectively rotating the coupling head so as to allow for affecting at least three configurations including—
  - a first configuration in which the ram is extended and the coupling head is rotated such that the pair of first faces are oriented vertically to interact with the receiver on the second vessel;
  - a second configuration in which the ram is extended and the coupling head is rotated such that the pair of second faces are oriented vertically to interact the receiver on the second vessel; and
  - a third configuration in which the ram is retracted and the coupling head is rotated such that the pair of second faces is oriented vertically but does not interact with the receiver of the second vessel.

10. The vessel coupling system as set forth in claim 9, wherein the first vessel is powered and the second vessel is unpowered, and wherein the vessel coupling system allows for compensating for a draft differential between the first vessel and the second vessel.

11. The vessel coupling system as set forth in claim 9, wherein there are at least two rams and two coupling heads, including a first ram and a first coupling head associated with a port side of the first vessel and a second ram and a second coupling head associated with a starboard side of the first vessel.

12. The vessel coupling system as set forth in claim 9, wherein the receiver includes an elongated vertical channel having sidewalls, and wherein the sidewalls include one or more second engagement structures adapted to interlock with the one or more first engagement structures.

13. The vessel coupling system as set forth in claim 9, wherein the one or more first engagement structures are one or more teeth.

14. The vessel coupling system as set forth in claim 9, wherein the substantially flat surface of each second face is a friction surface.

15. The vessel coupling system as set forth in claim 9, wherein each first face is ninety degrees removed from each second face about the coupling head.

16. A vessel coupling system for coupling a first vessel with a second vessel and for allowing for compensating for a draft differential between the first vessel and the second vessel, wherein the second vessel includes a first receiver associated with a port side of the second vessel and a second receiver associated with a starboard side of the second vessel, and each of the first and second receivers includes an elongated vertical channel having sidewalls, the vessel coupling system comprising:

a first ram associated with a port side of the first vessel, and a second ram associated with a starboard side of the first vessel, with each ram being independently and selectively extendable and retractable; and a first coupling head associated with an end of the first ram, and a second coupling head associated with an end of the second ram, with each coupling head including— a pair of first faces located on opposite sides of the coupling head, with each first face including one or more first engagement structures adapted to interlock with one or more second engagement structures located on the sidewalls of the respective receiver, and a pair of second faces located on opposite sides of the coupling head, with each second face including a substantially flat surface, wherein the coupling head is selectively rotatable so as to orient either the pair of first faces or the pair of second faces vertically for interaction with the respective receiver.

17. The vessel coupling system as set forth in claim 16, wherein the first vessel is a powered pusher vessel and the second vessel is an unpowered barge.

18. The vessel coupling system as set forth in claim 16, wherein the one or more first engagement structures are one or more teeth.

19. The vessel coupling system as set forth in claim 16, wherein the substantially flat surface of each second face is a friction surface.

20. The vessel coupling system as set forth in claim 16, wherein each first face is ninety degrees removed from each second face about the coupling head.

* * * * *